US009979103B2

(12) United States Patent
Pari

(10) Patent No.: US 9,979,103 B2
(45) Date of Patent: May 22, 2018

(54) CONNECTOR ARRANGEMENT

(71) Applicant: Nokia Solutions and Networks Oy, Espoo (FI)

(72) Inventor: Mika Petri Pari, Tupos (FI)

(73) Assignee: Nokia Solutions and Networks Oy, Espoo (FI)

( * ) Notice: Subject to any disclaimer, the term of this patent is extended or adjusted under 35 U.S.C. 154(b) by 0 days. days.

(21) Appl. No.: 15/381,297

(22) Filed: Dec. 16, 2016

(65) Prior Publication Data

US 2017/0098898 A1 Apr. 6, 2017

Related U.S. Application Data

(63) Continuation of application No. 14/825,598, filed on Aug. 13, 2015, now Pat. No. 9,559,441.

(30) Foreign Application Priority Data

Aug. 15, 2014 (EP) ..... 14181119

(51) Int. Cl.

| | |
|---|---|
| ***H01R 4/50*** | (2006.01) |
| ***H01R 9/05*** | (2006.01) |
| ***H01R 13/6581*** | (2011.01) |
| ***H01R 9/18*** | (2006.01) |
| ***H01R 13/631*** | (2006.01) |
| ***H01R 13/719*** | (2011.01) |

(52) U.S. Cl.

CPC ..... *H01R 9/05* (2013.01); *H01R 9/18* (2013.01); *H01R 13/6315* (2013.01); *H01R 13/6581* (2013.01); *H01R 13/719* (2013.01)

(58) Field of Classification Search

CPC .. H01R 9/05; H01R 13/6581; H01R 13/6277; H01R 13/6315; H01R 13/719; H01R 9/0503

USPC ..... 439/345

See application file for complete search history.

(56) References Cited

U.S. PATENT DOCUMENTS

| | | | | |
|---|---|---|---|---|
| 4,227,765 A | 10/1980 | Neumann et al. | ..... | 339/143 R |
| 4,925,403 A * | 5/1990 | Zorzy | ..... | H01R 13/6315 439/578 |
| 5,217,392 A * | 6/1993 | Hosler, Sr. | ..... | H01R 9/0503 174/88 C |
| 7,442,080 B1 * | 10/2008 | Tsen | ..... | H01R 9/0503 439/181 |

(Continued)

FOREIGN PATENT DOCUMENTS

| | | |
|---|---|---|
| DE | 20023071 U1 | 12/2002 |
| WO | WO 0052788 A1 | 9/2000 |

*Primary Examiner* — Jean F Duverne

(74) *Attorney, Agent, or Firm* — Harrington & Smith

(57) ABSTRACT

A connector arrangement, comprising a connector comprising an outer connector, an inner connector, and attaching means for attaching the connector to a first object, the connector being movable in relation to the first object; a second connector comprising a second outer connector, a second inner connector, and second attaching means for attaching the second connector to a second object and a bullet connector comprising a bullet outer connector and bullet inner connector. The bullet outer connector is configured to make a contact with the first and the second connector to form first and second conductive signal paths from the first connector to the second connector.

21 Claims, 5 Drawing Sheets

(56) References Cited

U.S. PATENT DOCUMENTS

| | | | | |
|---|---|---|---|---|
| 7,918,682 | B2 * | 4/2011 | Hirai | H01Q 1/1278 439/374 |
| 8,323,058 | B2 | 12/2012 | Flaherty | 439/680 |
| 8,734,167 | B2 | 5/2014 | Aimoto | 439/74 |
| 9,190,786 | B1 | 11/2015 | Baumler | |
| 9,270,018 | B2 * | 2/2016 | Mierke | H01Q 1/1214 |
| 9,281,595 | B2 | 3/2016 | Namjoshi | |
| 2002/0061670 | A1 * | 5/2002 | Havener | H01R 13/6315 439/246 |
| 2006/0194465 | A1 * | 8/2006 | Czikora | H01R 13/6315 439/248 |
| 2009/0040121 | A1 | 2/2009 | Rosenberger et al. | 343/713 |
| 2010/0297867 | A1 | 11/2010 | Rosenberger | 439/345 |
| 2011/0151714 | A1 * | 6/2011 | Flaherty | H01R 13/6277 439/578 |

* cited by examiner

CONNECTOR ARRANGEMENT

CROSS REFERENCE

This patent application is a continuation application of U.S. patent application Ser. No. 14/825,598, filed Aug. 13, 2015, the disclosure of which is incorporated by reference herein in its entirety.

FIELD OF THE INVENTION

The exemplary and non-limiting embodiments of the invention relate generally to connectors or connector arrangement that can be employed to interconnect radiofrequency apparatuses or components. Embodiments of the invention relate especially to coaxial connector arrangements that can be employed in radio frequency apparatuses.

BACKGROUND

The following description of background art may include insights, discoveries, understandings or disclosures, or associations together with disclosures not known to the relevant art prior to the present invention but provided by the invention. Some of such contributions of the invention may be specifically pointed out below, whereas other such contributions of the invention will be apparent from their context.

Connectors are used in radiofrequency apparatuses to connect apparatuses or components within an apparatus electrically to each other. For example, a typical arrangement in connecting a power amplifier of a radio transmitter is to an antenna arrangement is to use a cable comprising connectors at the both ends of the cable. The cable with the connectors provides the radio frequency signal produced by the power amplifier a path to the antenna. Connectors are typically attached by small screws or press fittings to radio module housing and the radio is connected to antenna by using different length of jumper cables. Similar arrangement may be used within a radio transmitter when the output signal of a filter is led to the power amplifier of the radio transmitter, for example.

A common problem with prior art connecting solutions is that there are many connection joints between different radiofrequency parts and that can generate passive intermodulation or other electrical/mechanical contact problems.

SUMMARY

In one exemplary embodiment, a connector arrangement comprises: an attaching portion configured to receive a first object; a spring-loaded bed disposed in the attaching portion, the spring-loaded bed configured to couple the attaching portion to the first object and to enable movement of the connector arrangement in relation to the first object in at least two different directions; an outer connector depending from the attaching portion; and an inner connector disposed in the outer connector and having a first end extending through the spring-loaded bed and into the attachment portion and having a protruding element at a second end thereof extending into the outer connector. The outer connector depending from the attaching portion is configured to make a contact with an outer connector on a second object to form a first conductive signal path from the outer connector depending from the attaching portion to the outer connector on the second object. The protruding element is configured to make a contact with a cavity in the second object to form a second conductive signal path from the inner connector to the cavity in the second object. The connector arrangement has no internal locking mechanism to provide mechanical stability for the conductive signal path.

In another exemplary embodiment, a connector arrangement comprises: a connector comprising an outer connector, an inner connector with a protruding element, and a spring-loaded bed for attaching the connector to a first object, the connector being movable in relation to the first object in at least two different directions. The outer connector is configured to attach the connector to a second object. The outer connector configured to attach the connector to the second object forms a first conductive signal path from the outer connector to an outer connector of the second object. The inner connector with a protruding element forms a second conductive signal path from the inner connector to a cavity of the second object. The connector arrangement has no internal locking mechanism to provide mechanical stability for the first and second conductive signal paths.

LIST OF DRAWINGS

Embodiments of the present invention are described below, by way of example only, with reference to the accompanying drawings, in which FIG. 1 illustrates an example of an arrangement where embodiments of the invention may be applied;

DESCRIPTION OF SOME EMBODIMENTS

The following embodiments are only examples. Although the specification may refer to "an", "one", or "some" embodiment(s) in several locations, this does not necessarily mean that each such reference is to the same embodiment(s), or that the feature only applies to a single embodiment. Single features of different embodiments may also be combined to provide other embodiments. Furthermore, words "comprising" and "including" should be understood as not limiting the described embodiments to consist of only those features that have been mentioned and such embodiments may also contain also features, structures, units, modules etc. that have not been specifically mentioned.

Figure 1:
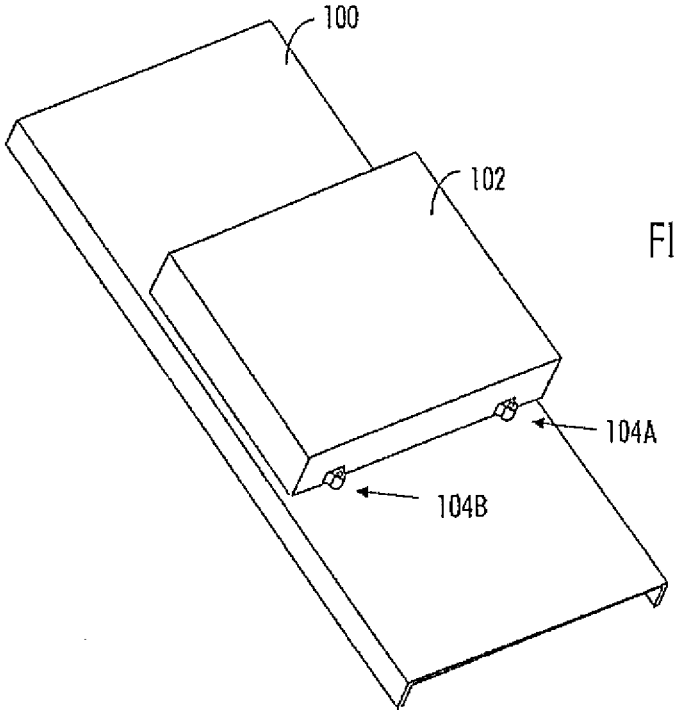

FIG. 1 illustrates an example of an arrangement where embodiments of the invention may be applied. The figure shows an antenna 100 and a radio part 102. The radio part 102 and the antenna 100 are connected together using fastening means 104A, 104B. (Corresponding two fastening means on the other side of the radio part are not shown for clarity). It may be noted that illustrated fastening means are only an example. The number and style of the fastening means may vary, The radio part 102 typically comprises a transceiver or transmitter configured to transmit using the antenna 100. The signal to be transmitted is amplified in a power amplifier of the transceiver or transmitter from which the signal to be transmitted is fed to an antenna or antenna arrangement 100. In prior art, a signal path from the power amplifier of the radio part 102 to the antenna 100 is realized using connectors in the radio part and the antenna and a connecting feeder or cable. Typical connector types used in the art are denoted as DIN 7-16 and 4.3-10. Typically, the connectors on radio part 102 and antenna 100 are socket contacts or female contacts while connectors used in connecting feeders or cables are pin contacts or male contacts.

In an embodiment, the use of connecting feeders or cables in the realization of the signal path between devices may be avoided by utilising the proposed connector arrangement. FIGS. 2A, 2B, 2C and 2D illustrate examples of connector arrangements. FIG. 2A illustrates a first connector 200 which is attachable to a first object (not shown). The first object may be an antenna or a power amplifier, for example. FIG. 2B illustrates a bullet connector 204. FIG. 2C illustrates a second connector 202 which is attachable to a second object (not shown). The second object may be a transceiver, a radio part or a filter, for example.

In an embodiment, the example connector arrangement comprises the first and second connectors and the bullet connector. This example is studied next.

In an embodiment, the first connector 200 comprises a first outer connector 206A, 206B and a first inner connector 208 with a protruding element 210. The first connector 200 further comprises first attaching means 212, 214 for attaching the first connector to the first object, the first connector being movable in relation to the first object in at least two different directions which may be orthogonal with each other. The first attaching means may comprise a spring loaded bed, for instance, which provide degrees of freedom in the movement of the first connector in at least two directions which may be orthogonal with each other. The movement may also be partly rotational.

In an embodiment, the second connector 202 comprises a second outer connector 216A, 216B and a second inner connector 218 with a protruding element 220. The second connector 202 further comprises first attaching means 222, 224 for attaching the second connector to the second object.

In an embodiment, the bullet connector 204 comprises a bullet outer connector 226A, 226B 226C, 226D and bullet inner connector 228.

Figure 2D:
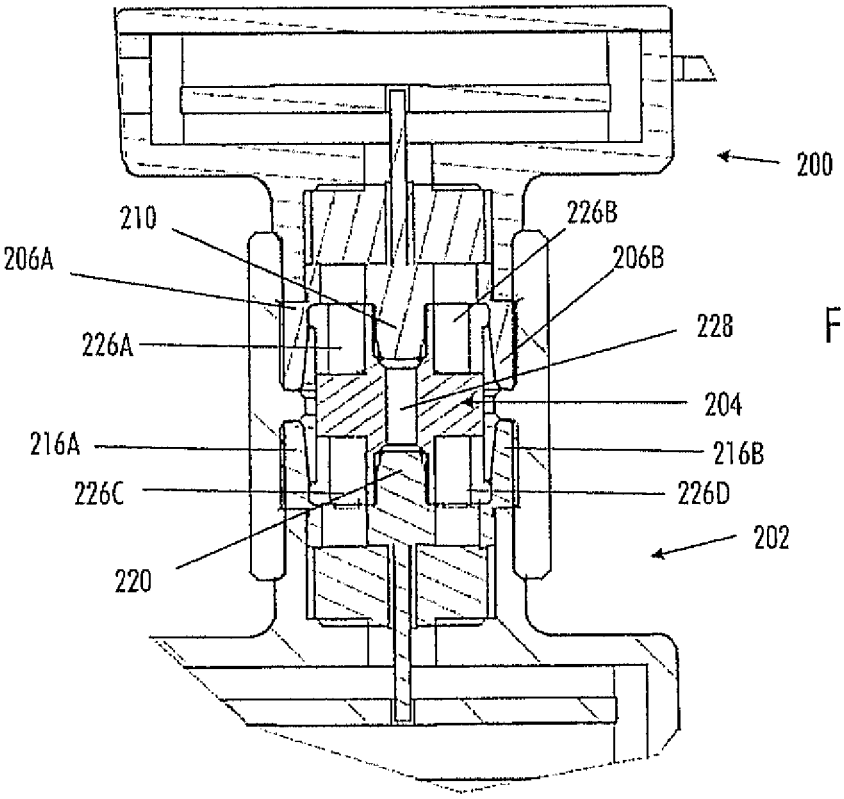
FIGS. 2A, 2B, 2C and 2D illustrate examples of connector arrangements.
Figure 2A:
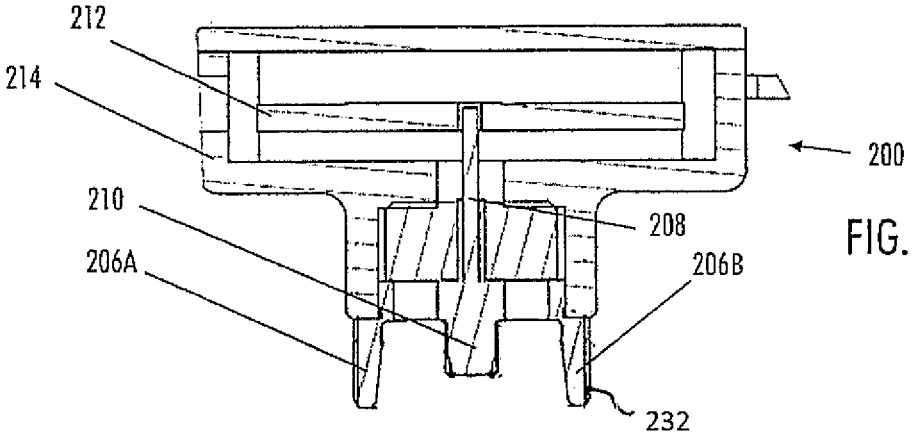
Figure 2B:
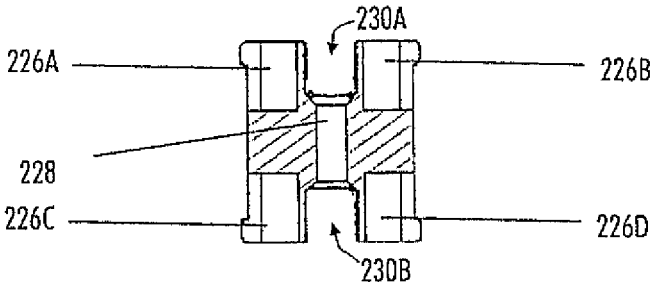
Figure 2C:
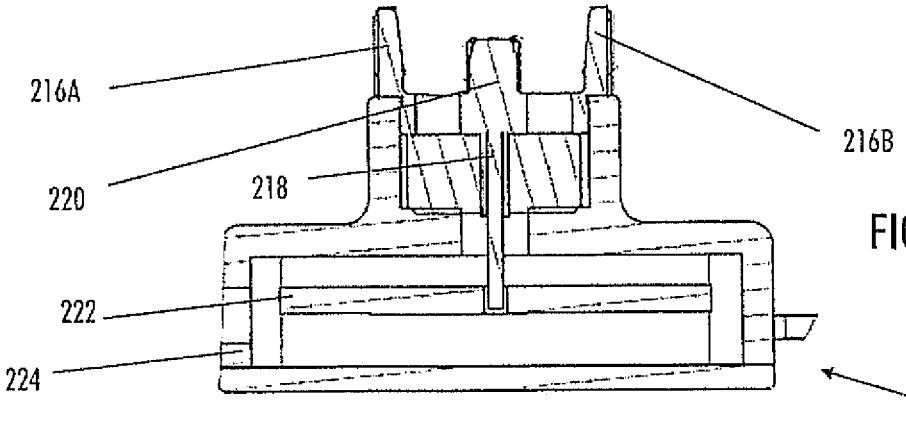

In an embodiment, the bullet connector 204 is attachable to the first 200 and second 202 connectors between the first and second connector, as illustrated in FIG. 2D. The bullet outer connector 226A, 226B 226C, 226D may be configured to make a contact with the first and the second outer connector 206A, 206B, 216A, 216B to form a first conductive signal path from the first outer connector 200 to the second outer connector 202.

The bullet inner connector 228 may comprise means 230A, 2308 for receiving the protruding elements 210, 220 of the first and second inner connectors to form a second conductive signal path from the first inner connector 200 to the second inner connector 202. The bullet connector may comprise cavity 230A, 230B matched to the protruding elements 210, 220 of the first and second inner connectors. The outer surfaces of the protruding elements 210, 220 and the inner surfaces of the cavities may comprise conductive material to enable forming the second conductive signal path.

In an embodiment, the connector arrangement comprises shielding means 232 attached to the outer surfaces of the first and second outer connectors connector 206A, 206B, 216A, 216B forming the first conductive signal path as illustrated in FIG. 2D. The shielding means may provide IP or EMC (Ingress Protection or Electromagnetic compatibility) sealing or both.

In an embodiment, the example connector arrangement comprises the first connector and the bullet connector. This example is studied next.

As in the previous example, the first connector 200 comprises a first outer connector 206A, 206B and a first inner connector 208 with a protruding element 210. The first connector 200 further comprises first attaching means 212, 214 for attaching the first connector to the first object, the first connector being movable in relation to the first object in at least two different directions which may be orthogonal with each other. The first attaching means may comprise a spring loaded bed, for instance, which provide degrees of freedom in the movement of the first connector in at least two directions which may be orthogonal with each other. The movement may also be partly rotational.

In an embodiment, the bullet connector 204 comprises a bullet outer connector 226A, 226B 226C, 226D and bullet inner connector 228.

In an embodiment, the bullet connector 204 is being attachable from a first side to the first connector 200. The bullet outer connector 226A, 226B of the first side may be configured to make a contact with the first outer connector 206A, 206B to form a first conductive signal path from the first outer connector 206A, 206B to the bullet outer connector 226A, 226B of the first side. The bullet inner connector 228 may comprise means 230A on the first side for receiving the protruding element 210 of the first inner connector to form a second conductive signal path from the first inner connector 200 to the bullet inner connector.

In an embodiment, the bullet connector 204 is further attachable from a second side to another connector. The bullet outer connector 226C, 226D of the second side may be configured to make a contact with an outer connector of the another connector to extend the first conductive signal path from the first outer connector to the outer connector of the another connector. The bullet inner connector 228 may comprise means 230B on the second side for receiving the protruding element of the inner connector of the another connector to extend the second conductive signal path from the first inner connector to inner connector of the another connector.

Figure 3:
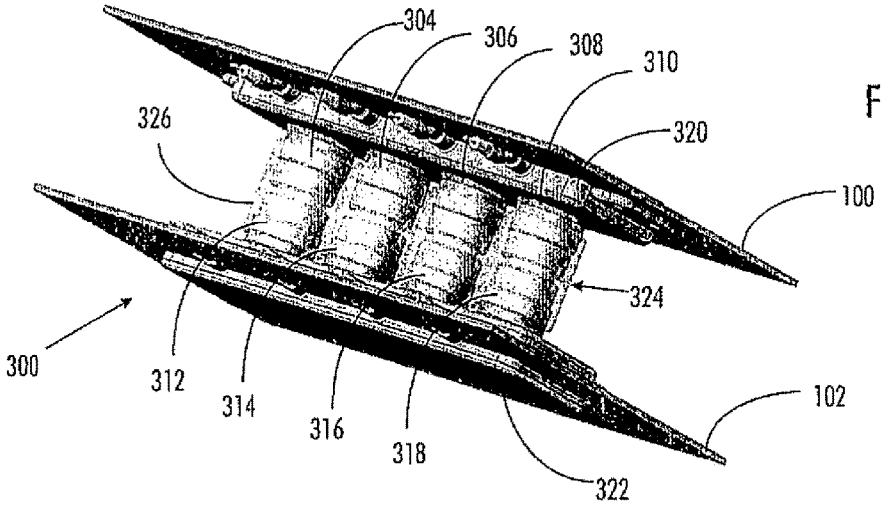
FIGS. 3 and 4 illustrate an example of a connector arrangement.
Figure 4:
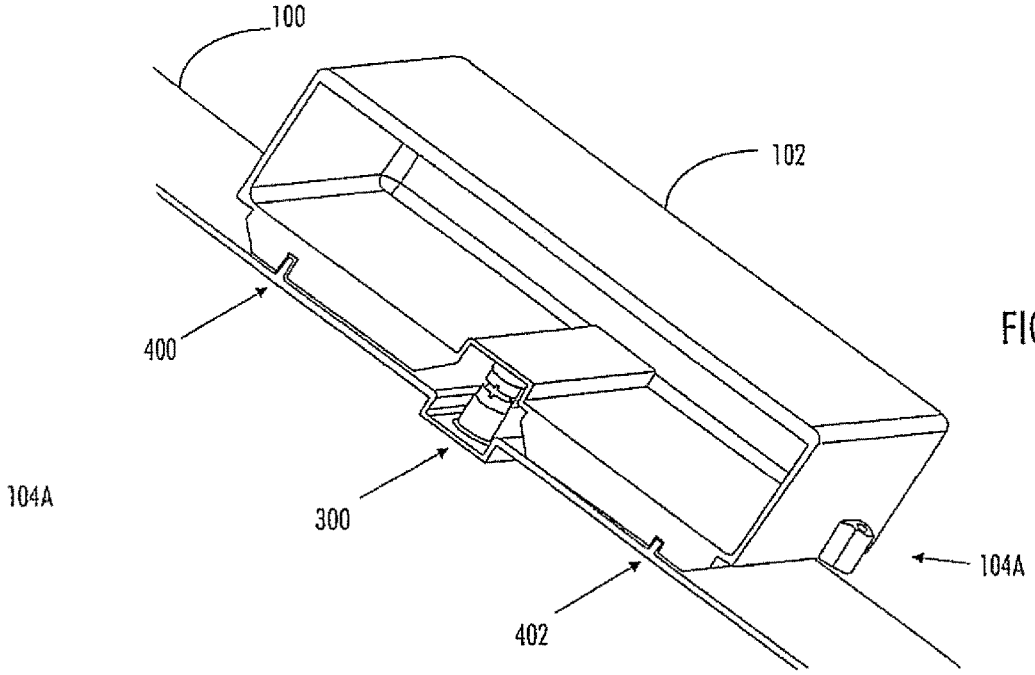

FIGS. 3 and 4 illustrate an example of a connector arrangement 300 of an embodiment. In FIG. 3, the first and second attaching means 320, 322 are common to more than one first and second connector. FIG. 3 illustrates an example where there is a need to realize four connections between the first object 100 and the second object 102. Four first connectors 304, 306, 308, 310 and four second connectors 312, 314, 316, 318 are connected with corresponding four bullet connectors 324. In the figure, the bullet connectors are below IP/EMC sealing 326.

FIG. 4 illustrates the example from another viewpoint. The first object 100 is a radio part and the second object is an antenna. The connector arrangement 300 provides electrical connection between the radio part and the antenna with four first connector-bullet connector-second connector combinations. The connector arrangement has no internal locking mechanism to provide mechanical stability for the connection. The radio part 102 and the antenna 100 are connected together using fastening means 104A. Similar fastening means may be on the other side of the radio part (not shown). The fastening means may be realized with a screw, bolt or any other suitable fastening arrangement known in the art. In an embodiment, the fastening means connecting the radio part and the antenna together provide also the mechanical stability for the connector arrangement. As the radio part and the antenna are locked together using the fastening means the connector arrangement achieves mechanical stability. In an embodiment, this kind of fastening enables the small size of the connector arrangement as there is no need for separate locking system for each connector-bullet connector-second connector combinations. In this example, all four combinations achieve mechanical stability with the same fastening means.

In an embodiment, the first connectors are movable in relation to the antenna 100 in at least two directions orthogonal with each other. The movability may be achieved by using a spring loaded bed, for instance. The connection of the first connectors may be called floating and the connection of the second connectors may be called fixed. The floating connection makes the connecting of the antenna and the radio part and the first connector-bullet connector-second connector combinations easier.

In an embodiment, guide elements or guiding means 400, 402 may be utilized to attach the antenna 100 into correct position with the radio part 102. The guiding means 400, 402 may comprise a plug in the antenna part and a cavity in the radio part or vice versa, for example. The use of guiding means makes it possible to direct the first and second outer connectors together with the accuracy smaller than the movement allowed by the floating connection. The floating connection may be either on the antenna side or on the radio part side.

Figure 5:
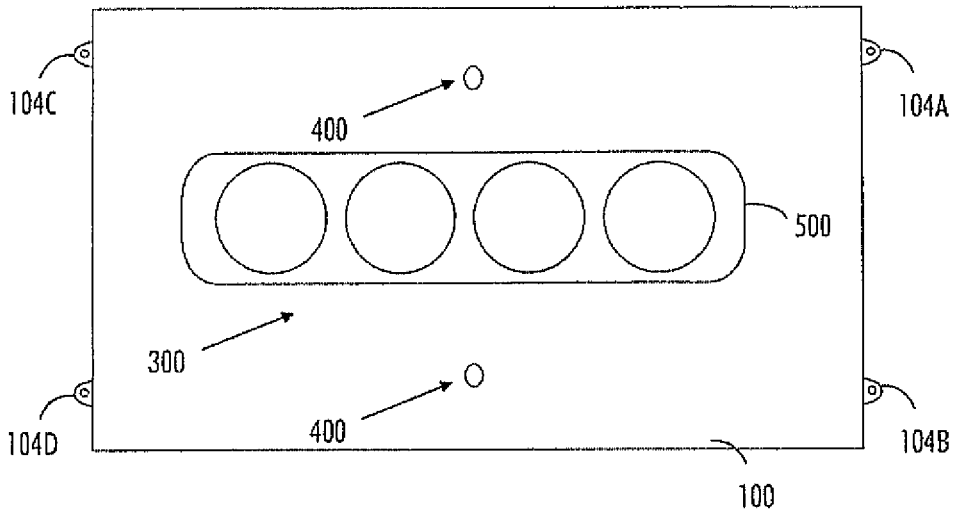
FIG. 5 illustrates the guiding means and floating connection.

FIG. 5 illustrates the guiding means and floating connection. FIG. 5 shows an example of the antenna 100 from the side facing the radio part. The side comprises the guiding means 400 and the connector arrangement 300 comprising in this example four first connector-bullet connector-second connector combinations. In an embodiment, the movable section 500 comprises the four first connector-bullet connector-second connector combinations. The fastening means 104A, 104B, 104C, 104D of the antenna part are common for the four first connector-bullet connector-second connector combinations.

Advantages of the described solution comprise are stabile structure and quick assembly. From the electrical point of view the length of radio frequency lines are shorter than in prior art solution using feeders or cables and that means lower losses in radiofrequency lines. In addition, phase variance is minimal because cable usage is minimized.

In prior art connectors comprise several parts such as connector housing (outer connector) insulator and inner connector part. This kind of structure causes connection joints between different radiofrequency parts that can generate for instance passive intermodulation or other electrical/mechanical contact problems and extra costs.

Figure 6:
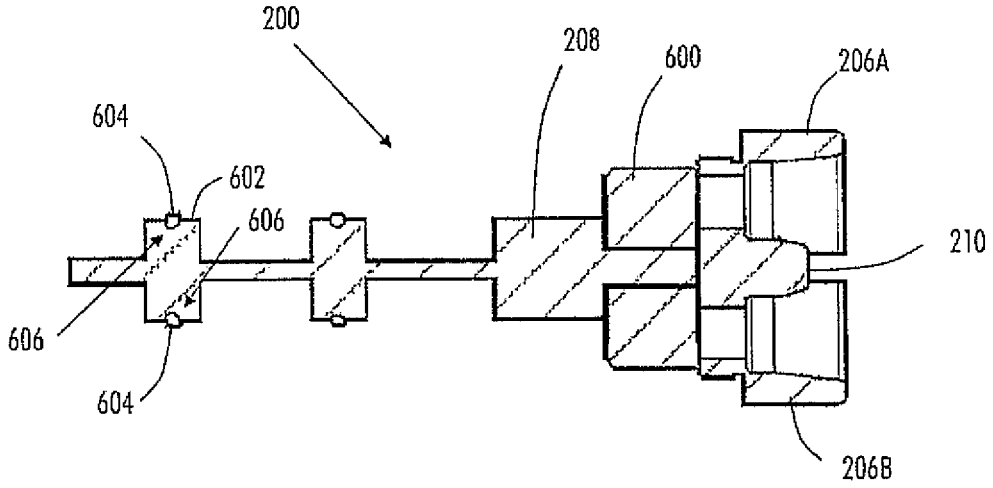
FIGS. 6 and 7 illustrate another example of a connector arrangement.
Figure 7:
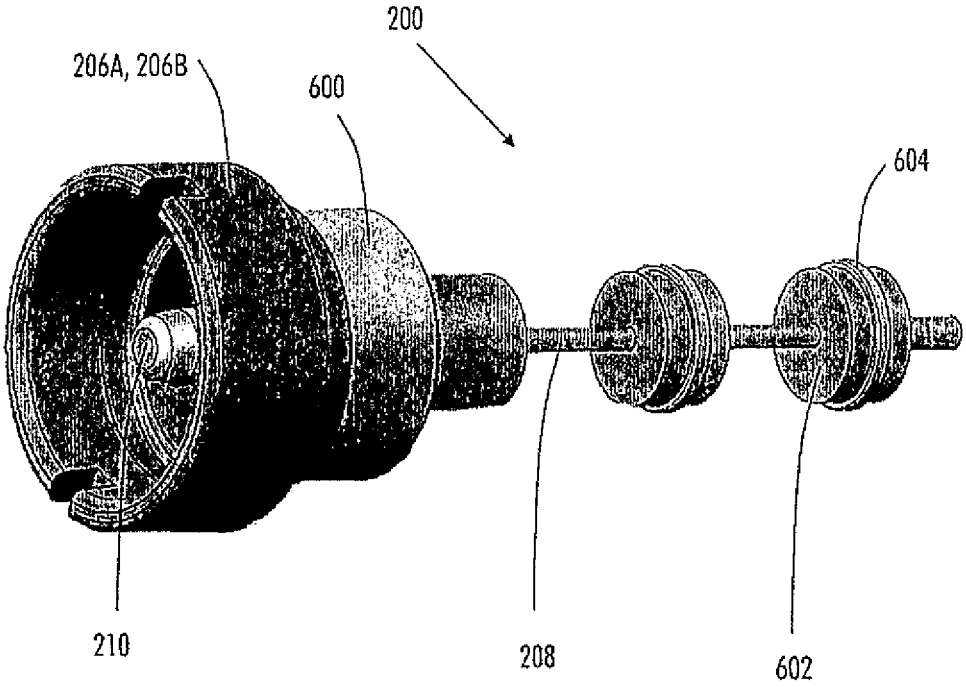

FIGS. 6 and 7 illustrate an embodiment of the invention, where the first and/or second inner connector comprises an integrated low pass filter in the same body as the protruding element. FIGS. 6 and 7 show an example of a first connector 200. The connecter might as well be the second connector or other connector. The connector 200 comprises outer connector 206A, 206B and an inner connector 208 with a protruding element 210. The outer connector may be formed of a single element.

In an embodiment, the inner connector 208 comprises a low pass filter 600 integrated to the same body as the inner connector. Thus, the low pass filter is of the same material and there are no joints between the protruding element 210 and the low pass filter.

In an embodiment, the inner connector 208 comprises one or more insulators 604, 602 axially surrounding at least part of the inner connector. In an embodiment, inner connector comprises one or more grooves 606 on a surface facing radially outwards of the inner connector. The insulator 604 of the inner connector may be attached to the one or more grooves. The insulator 604 of the inner connector 208 may be injection moulded to the one or more grooves 606, for instance.

The proposed solution leads to a good mechanical structure that is easy to implement. Minimizing amount of parts and joints leads to a shorter tolerance chain. The structure is stabile structure and quick to assemble in production. In addition, parts of the connector can be reused if needed for example in production failure situation. Reducing the number of parts and joints and the ease of assembly leads also to cost reduction. For example, typically in connectors a FEP (fluor plastics) tube is used for supporting and isolating a separate low pass filter. In the proposed structure the use of the FEP tube, which is difficult to produce accurately, is avoided as insulation may be provided by insulator bands attached to grooves of the inner connector material.

It will be obvious to a person skilled in the art that, as the technology advances, the inventive concept can be implemented in various ways. The invention and its embodiments are not limited to the examples described above but may vary within the scope of the claims.

The invention claimed is:

1. A connector arrangement, comprising:

an attaching portion configured to receive a first object and couple the first object thereto, wherein the attaching portion is configured to enable movement of the connector arrangement in relation to the first object in at least two different directions;

an outer connector extending from the attaching portion; and an inner connector disposed in the outer connector and having a first end extending into the attaching portion and having a protruding element at a second end thereof extending into the outer connector;

wherein the outer connector extending from the attaching portion is configured to make contact with an outer connector on a second object to form a first conductive signal path from the outer connector extending from the attaching portion to the outer connector on the second object;

wherein the protruding element is configured to make contact with a cavity in the second object to form a second conductive signal path from the inner connector to the cavity in the second object;

wherein the connector arrangement comprises a locking mechanism comprising a fastener to a couple the first object to the second object to provide mechanical stability for the conductive signal path.

2. The connector arrangement of claim 1, further comprising a shield attached to an outer surface of the outer connector extending from the attaching portion forming the first conductive signal path.

3. The connector arrangement of claim 1, wherein the attaching portion provides for the movement in at least two directions orthogonal with each other.

4. The connector arrangement of claim 1, further comprising an integrated low pass filter circumferentially located around the inner connector.

5. The connector arrangement of claim 4, wherein the integrated low pass filter comprises the same material as the inner connector.

6. The connector arrangement of claim 5, wherein there are no joints between the protruding element and the integrated low pass filter.

7. The connector arrangement of claim 4, wherein the inner connector comprises an insulator axially surrounding at least part of the inner connector.

8. The connector arrangement of claim 7, wherein the inner connector comprises one or more grooves on a surface facing radially outwards of the inner connector, the insulator of the inner connector being attached to the one or more grooves.

9. The connector arrangement of claim 8, wherein the insulator of the inner connector is injection molded to the one or more grooves.

10. A first object comprising the connector arrangement of claim 1, wherein the first object is an antenna.

11. A second object comprising the connector arrangement of claim 1, wherein the second object is a filter.

12. A second object comprising the connector arrangement of claim 1, wherein the second object is a bullet connector and is further configured to receive an outer connector on a third object and a second protruding element from the third object.

13. The connector arrangement of claim 1, wherein the attaching portion configured to receive a first object and couple the first object thereto comprises a spring-loaded bed.

14. A connector arrangement, comprising:

a connector comprising an outer connector and an inner connector with a protruding element, a first end of the outer connector being configured to attach the connector to a first object, the connector being movable in relation to the first object in at least two different directions;

wherein a second end of the outer connector is configured to attach the connector to a second object;

wherein the second end of the outer connector configured to attach the connector to the second object forms a first conductive signal path from the outer connector to an outer connector of the second object;

wherein the inner connector with a protruding element forms a second conductive signal path from the inner connector to a cavity of the second object; and wherein the connector arrangement comprises a locking mechanism comprising a fastener to couple the first object to the second object to provide mechanical stability for the first and second conductive signal paths.

15. The connector arrangement of claim 14, further comprising an integrated low pass filter circumferentially located around the inner connector.

16. The connector arrangement of claim 15, wherein the integrated low pass filter comprises the same material as the inner connector.

17. The connector arrangement of claim 15, wherein there are no joints between the protruding element and the integrated low pass filter.

18. The connector arrangement of claim 15, wherein the inner connector comprises an insulator axially surrounding at least part of the inner connector.

19. The connector arrangement of claim 18, wherein the inner connector comprises one or more grooves on a surface facing radially outwards of the inner connector, and the insulator of the inner connector is attached to the one or more grooves.

20. A second object comprising the connector arrangement of claim 14, wherein the second object is a bullet connector and is further configured to receive a second protruding element from a third object.

21. The connector arrangement of claim 14, wherein the first end of the outer connector comprises a spring-loaded bed.

* * * * *